US005701708A

United States Patent [19]

Taraba et al.

[11] Patent Number: 5,701,708

[45] Date of Patent: Dec. 30, 1997

[54] STRUCTURAL FOAM CORE PANELS WITH BUILT-IN HEADER

[76] Inventors: Emil M. Taraba; Jeffrey M. Taraba, both of 1862 Hollow Road, Fonthill, Ontario, Canada, L0S 1E0

[21] Appl. No.: 629,778

[22] Filed: Apr. 9, 1996

[51] Int. Cl.[6] ..... E04C 2/32

[52] U.S. Cl. ..... 52/309.9; 52/210; 52/223.7; 52/264; 52/268; 52/284; 52/309.14; 52/586.1; 52/793.11

[58] Field of Search ..... 52/266, 271, 270, 52/268, 269, 267, 455, 456, 794.1, 309.9, 309.14, 223.7, 223.6, 210, 264, 284, 586.1

[56] References Cited

U.S. PATENT DOCUMENTS

| | | | |
|---|---|---|---|
| 4,163,349 | 8/1979 | Smith . | |
| 4,290,246 | 9/1981 | Hilsey | 52/223.7 X |
| 4,813,193 | 3/1989 | Altizer | 52/210 |
| 4,852,310 | 8/1989 | Henley et al. . | |
| 4,894,974 | 1/1990 | Mayhew et al. | 52/793.11 X |
| 5,519,971 | 5/1996 | Ramirez | 52/309.9 X |

*Primary Examiner*—Wynn E. Wood
*Assistant Examiner*—Timothy B. Kang
*Attorney, Agent, or Firm*—Young & Basile, P.C.

[57] ABSTRACT

A structural foam core panel for use in building construction, has inner and outer structural skins with interconnecting insulating foam core to form a structural building unit of standard building height and width such that when several panels are erected and interconnected in series, a load bearing wall is formed. The panel has a top load carrying header plate bridging and secured to the inner and outer structural skins with the foam core provided above and below the header plate. The top header plate spans the width of the panel and extends parallel to a bottom edge of the panel. header plate has an underside spaced from the panel bottom edge, a predetermined height for a top header plate to provide thereby load carrying support above a window opening or a door opening subsequently cut in the panel after interconnection of several panels in erecting a perimeter load bearing building wall.

10 Claims, 5 Drawing Sheets

10
12
14
16
18
20
22
24
26

16
24
40
56
60
62
64
67
54
58
48
52
38
34
50
36
42
28
16
44
46
30
32

50
16
28
38
34
128
36
140
131
122
30
32

STRUCTURAL FOAM CORE PANELS WITH BUILT-IN HEADER

FIELD OF THE INVENTION

This invention relates to structural foam core panels for use in building construction.

BACKGROUND OF THE INVENTION

The concept of building homes from modular structural units is most desirable but has met with considerable resistance in the building trade due to the need of customizing the modular units to accommodate various building designs. Modular units however offer standardized dimensionally correct surfaces for floors and walls of buildings. It is appreciated in the trade that a structural foam core panel having inner and outer structural skins with interconnecting insulating foam core forms an acceptable load carrying structural building unit. With the systems that are presently available in the market place, the structural foam core panel is most economically used in buildings all of the same space so that the custom portions for the panels can also be pre-made to accommodate the irregularities in the building design. However, such systems are not practical in most building designs because of the desire for adjacent buildings to appear different.

Examples of such prior structural foam core panels are described in U.S. Pat. Nos. 4,163,349 and 4,852,310. The insulating panel of U.S. Pat. No. 4,163,349 does not consider the details in respect of how windows, doors and other openings would be formed in the panel wall other than suggesting that special window and door panels may be provided with appropriate headers and other features to provide for windows, doors and other custom features within any particular wall section. U.S. Pat. No. 4,852,310 addresses this issue in more detail in describing the special panels which form the bottom portion of a window and the header portion of a window. These items are installed individually and filler strips are used to vary the opening size to accommodate various window openings. With such an arrangement however, the window panels and door panels are of a width as determined by the width of the door or window. Hence, with this type of construction, special panels have to be made for each building to accommodate varying widths of windows and doors. It is an object of an aspect of this invention, to overcome the problems associated with the prior types of structural foam core panel construction and in the process of solving those problems, several significant advantages have now been realized.

SUMMARY OF THE INVENTION

According to an aspect of the present invention, a structural foam core panel for use in building construction has inner and outer structural skins with interconnecting insulating foam core to form a structural building unit of standard building height and width such that when several panels are erected and interconnected in series, a load bearing wall is formed. The panel has a top load carrying header plate bridging and secured to the inner and outer structural skins with the foam core provided above and below the header plate. The top header plate spans the width of the panel and extends parallel to a bottom edge of the panel. The header plate has an underside spaced from said panel bottom edge a predetermined height to provide thereby load carrying support above a window opening or a door opening subsequently cut in the panel after interconnection of several panels in erecting a perimeter load bearing building wall.

BRIEF DESCRIPTION OF THE DRAWINGS

Various aspects of the invention are described with respect to the drawings wherein.

DETAILED DESCRIPTION OF THE PREFERRED EMBODIMENTS OF THE INVENTION

Figures 1, 2, 2A:
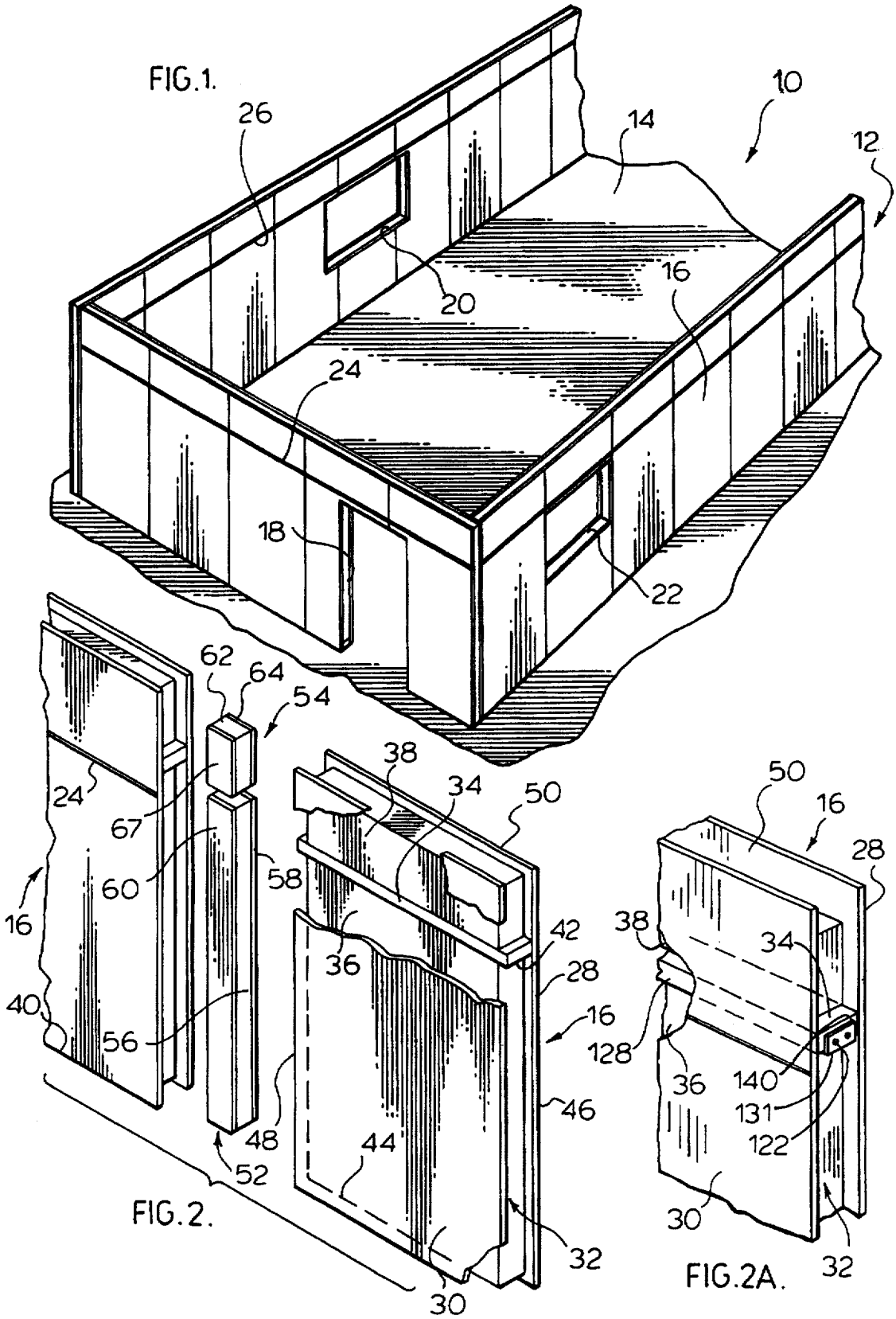
FIG. 1, is a perspective view of a perimeter wall for a building made from structural foam core panels in accordance with a preferred embodiment of this invention, showing various opening sizes for windows and a door.
FIG. 2, is an exploded view of 2 panels to be interconnected.
FIG. 2A, is a perspective view of a portion of the panel adapted to receive a post-tensioning cable.

FIG. 1 shows a building 10 having its perimeter wall 12 erected on a deck 14. The deck 14 may be a concrete made or wood floor, where the floor 14 is the first, second, third floor of the building. The perimeter wall 12 is made up of interconnected structural building units 16, which are in accordance with the structural foam core panels of this invention. After the entire perimeter wall 12 of the building is erected using the foam core panels, appropriate openings may be cut in the panels to form the openings for the door 18 and windows 20 and 22. In accordance with an aspect of the invention, a line 24 is provided on the outside skin of the panel and a corresponding line 26 is provided on the inside skin of each panel. The purpose of these lines will become apparent in respect of cutting out of the openings such as described with respect to FIG. 6. The significant advantage of the foam core panel of this invention is that the entire perimeter wall for the building may be formed before any openings are cut out. This allows one to enclose the entire building perimeter and install a second floor or roof before any openings are cut out except perhaps for a door opening, thereby, protecting the interior of the building from the elements. By using the structural foam core panels of this invention, the perimeter wall may be constructed rapidly. For example, with a standard size home having a first floor area of 1200 to 2000 sq. feet, the perimeter wall may be set up usually in less than half a day. Subject to inserting internal partitioning, the second floor or roof may go on the building very quickly, usually providing a closed in first floor within one to two days of construction.

As will become apparent in discussing the erection of these panels, there is no need for interior bracing. This leaves the entire floor area open to facilitate the construction of internal partitioning on the floor 14 and rapid set up of the same within the enclosed building.

As shown in FIG. 2, the building panels 16 are fabricated to facilitate interconnection of the panels in series. Each building panel 16 has an inner skin 28 and an outer skin 30 interconnected by an insulating foam core 32. This sandwiched construction is very sturdy and is quite capable of forming a load bearing structure. The inner and outer skins 28 and 30 may be formed of building grade plywood or oriented strand board (OSB). Normally the inner and outer skins are approximately 7/16 inch to ¾ inch thick. The foam core 32 is preferably secured to the inner and outer skins preferably by the use of adhesive to form a structural building unit of standard building height and width. In accordance with North American practice, each building panel has inner and outer skins of a width of 4' and a height of 8'. When all of the panels are properly interconnected, a load bearing perimeter wall is formed.

Figure 8:
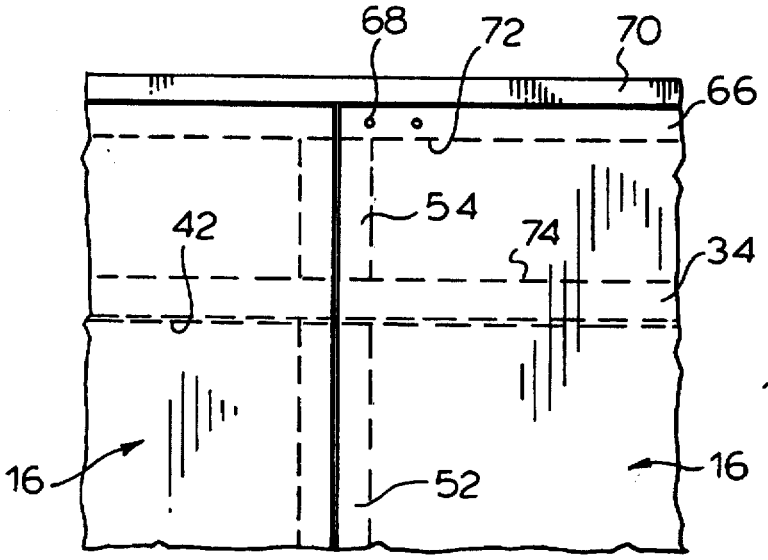
FIG. 8, is a section of the joint region between interconnected panels.

The major problem with prior panels has been overcome in accordance with this invention by the provision of a top load carrying header plate 34 in each panel. The header plate 34 bridges and is secured to the inner and outer skins 28 and 30 where the foam core is made up of two portions 36 and 38, so as to provide a foam core above and below the header plate. The header plate 34 spans the width of the panel or the equivalent thereof, depending upon the manner in which the header plates are interconnected and extends parallel to the bottom edge 40 of the panel. As will be described in more detail with respect to FIG. 6, the underside 42 of the header plate is spaced from panel bottom edge 40 a predetermined height to provide thereby load carrying support above a window opening such as 20 or 22, or a door opening such as 18 which are subsequently cut in the panel after interconnection of the several panels in erecting the perimeter load bearing wall 12. The foam core 36 is inset as represented by dotted line 44 from the bottom edge 40 of the panel. Correspondingly, foam core 36 and 38 is inset from the side edges 46 and 48 of the inner and outer skins. The top foam core 38 is also inset from the top edge 50 of the respective panel. This provides a channel along the bottom, top and side edges of the panel. The channel along the bottom and the top of the panel accommodate standard bottom and top building plates and the channels along each side of the panel receive and accommodate a connector stud 52 below the header plate 42 and a connector cripple stud 54 above the top header plate. The connector stud 52 has a foam core 56 with inner and outer skins 58 and 60 of plywood or OSB. The thickness of the connector stud is slightly less than the spacing between the interior surfaces of the inner and outer skins 28 and 30, where such snug fit is shown in more detail in FIG. 4. Similarly, with the connector cripple stud 54, it has the foam core portion 62 with inner and outer skins 64 and 67 of plywood or OSB. The dimensional considerations in making the connector stud and the cripple stud is shown in the detail section of FIG. 8. Interconnected panels 16 have the usual top plates in position. The first top plate 66 is placed in the top channel of the panel and secured in place by nails, screws or the like 68. The second top plate 70 is secured to plate 66 in the usual manner by nails, screws and the like. An alternative for the top plates will be described in respect of FIG. 9. It is also appreciated that suitable panel adhesives may be used in place of the nails or screws to complete each panel joint.

The top header plate end 42, in accordance with this embodiment, extends to the edge 46 of each panel so that the header end 42 abut one another at the connection of the two panels. These headers may be secured to one another in a variety of ways. For example, screws or nails may be angled from one panel at the level of the header into the header of the other panel to form a secure connection. Another alternative is considered in FIGS. 2A and 10.

Figure 3:
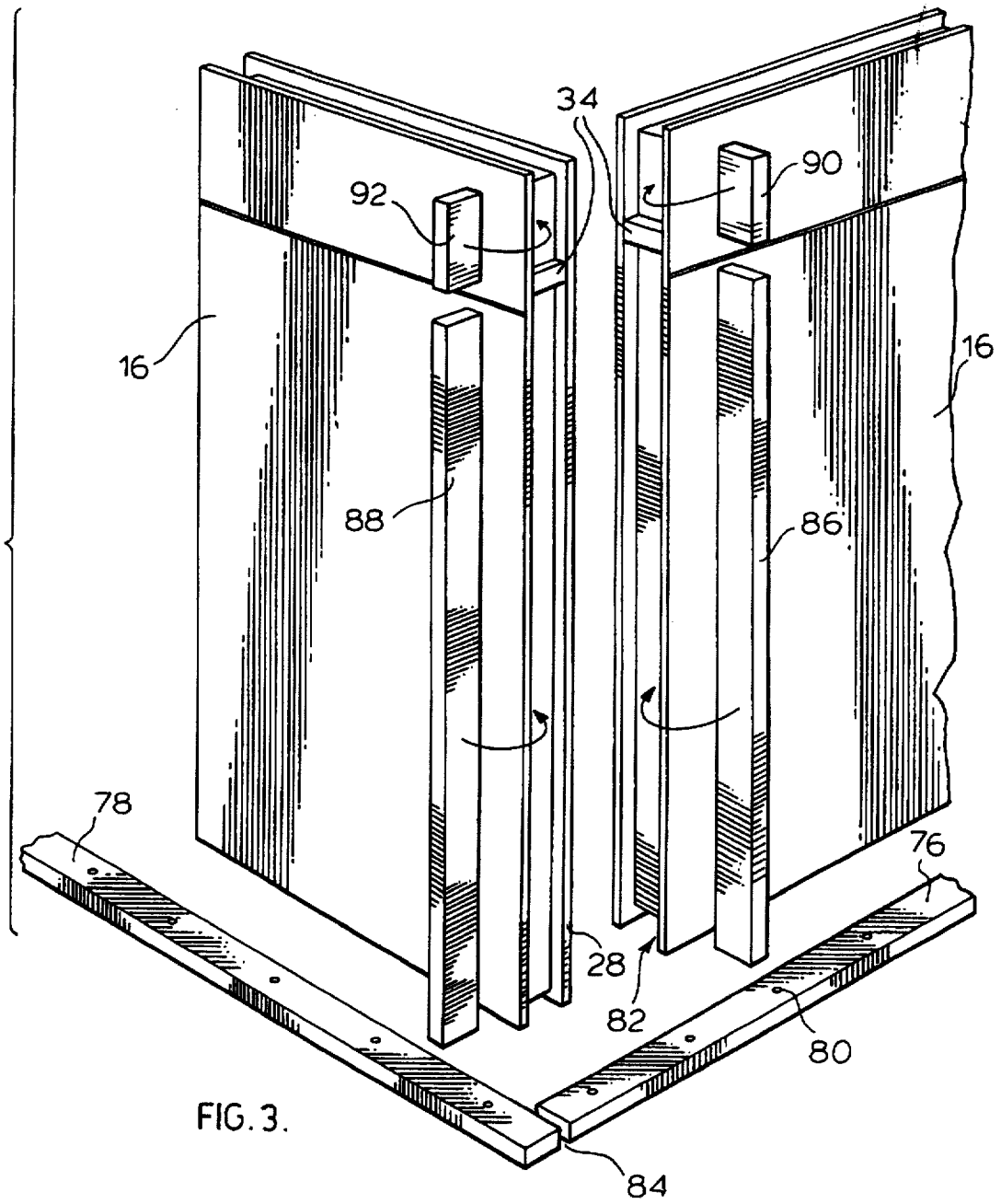
FIG. 3, is an exploded view of 2 panels to be interconnected at the corner of a building.

The connector stud 52 extends from the bottom plate which is shown in FIG. 3 and abuts the underside of end 42 of the header. The cripple stud 54 abuts the underside 72 of the plate 66 and the top 74 of the top header plate 34 in the final assembly. This construction transfers the load carried by the plate 70 through cripple stud 54, top plate 34 and connector stud 52 through to the bottom plate of the wall construction. By this type of connection, the load also carried by the top header plate 34 by virtue of window or door openings is transferred to the inner and outer skins as well as the adjacent connector stud 52 regardless of whether the stud is part of the panel in which the opening is provided or a stud of a panel in which only part of the opening is provided.

Figure 5A:
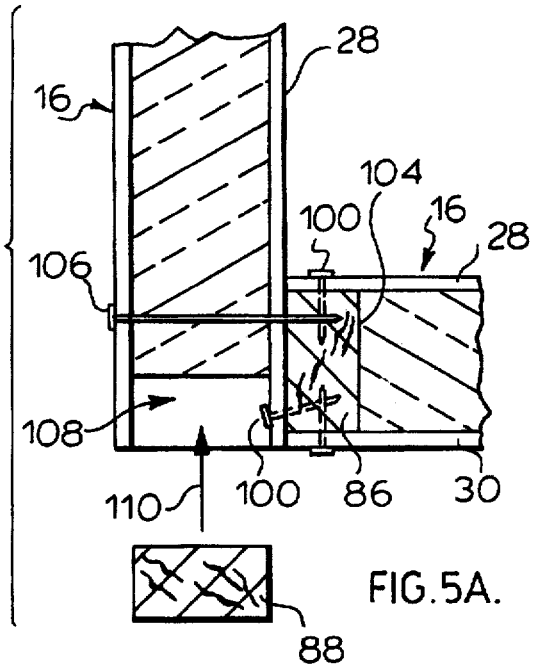
FIGS. 5*a* and 5*b* show the assembly of a corner.
Figure 5B:
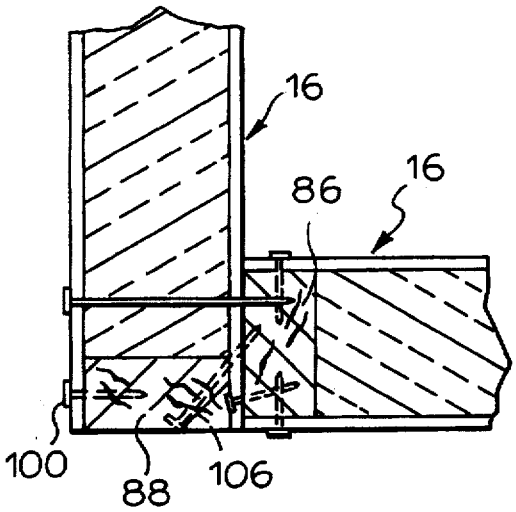

In FIG. 3 a corner assembly is shown which also serves to demonstrate the manner in which the panels are connected to the floor. Usual bottom plates 76 and 78 are nailed or screwed to the floor with fasteners 80. The channel 82 along the bottom of the panel 16 has the plate 76 inserted therein by lowering the panel on to the plate. Panels 16 abut one another and are interconnected by panel 16 resting on plate 78 where the inner skin 28 passes through the opening 84 between plates 78 and 80. Connector studs 86 and 88 are used in conjunction with the cripple studs 90 and 92 to complete the interconnection of the corner in accordance with the sequence described in FIG. 5.

Figure 4:
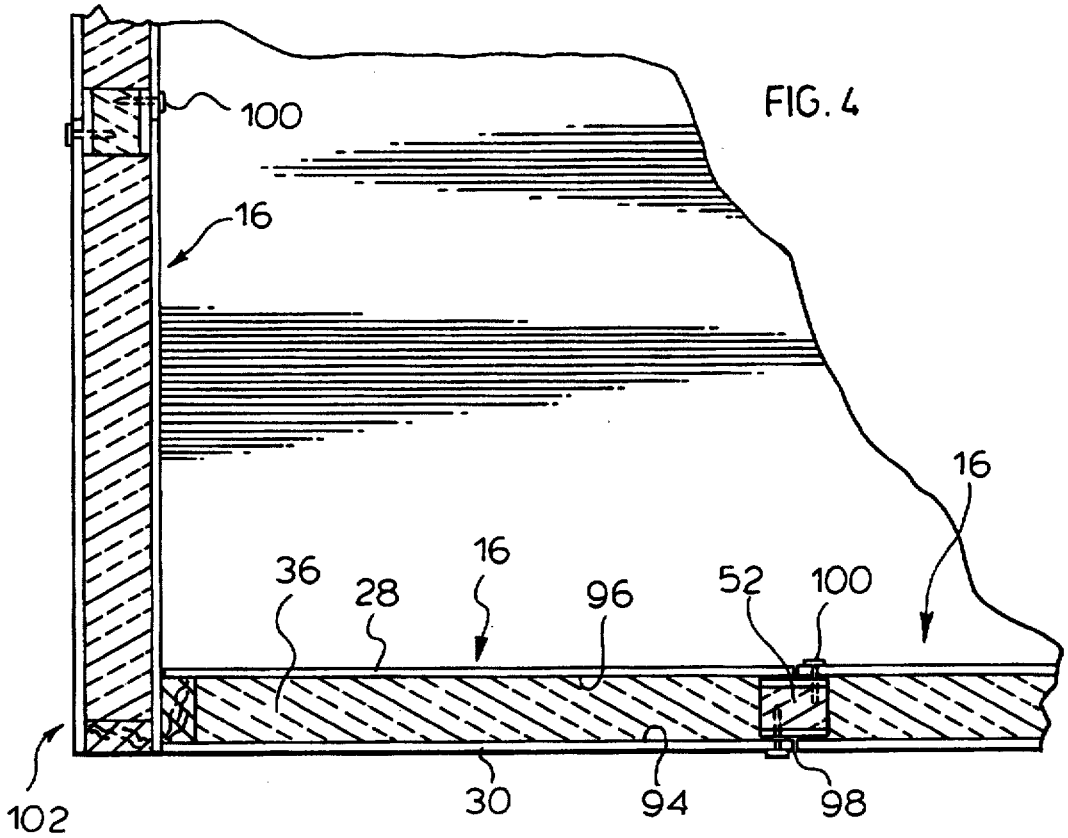
FIG. 4, is a section through the assembled corner.

As shown in FIG. 4, panels 16 are interconnected end to end in series in straight line by use of the connector stud 52 and top cripple stud 54. The connector stud 52 is of a dimension to fit snugly between the interior faces 94 and 96 of the inner and outer skins 28 and 30. The panels abut one another at the joint 98 and are interconnected through the stud 52 by use of suitable fasteners 100 which may be screws or nails. The corner region 102 may be assembled in a variety of ways depending upon the surroundings and availability of scaffolding and the like. In the embodiment shown in FIGS. **5*a* and 5*b*, panel 16 has its recess 104 filled with stud 86 and secured to the inner and outer skins 28 and 30 with the fasteners 100. The other panel 16 has its inner skin 28 abutting the stud 86 and is secured thereto by spike 106 and fastener 100 which may also be a suitable spike. The remaining stud 88 is then inserted in the recess 108 in the direction of arrow 110 and the assembly completed by use of fasteners 100 and spikes 106 to complete the corner assembly. It is appreciated that this assembly may also be accomplished on the floor by instead securing on the inner skin 28, stud 104 in the position shown in FIG. 5*a*. Then securing in recess 108, stud 88 again by appropriate fasteners. This panel is then mounted on the plate 78. The other panel is then brought into position and the inner and outer skins 28 and 30 are secured to stud 86** by use of suitable fasteners.

With the perimeter wall fully erected and the next floor or roof applied to the upper surface of the perimeter wall, the floor is now totally enclosed by the erected panels. In order to provide access to the floor, a suitable opening such as the door opening may be cut out where desired to facilitate access to the floor. The remainder of the perimeter walls may be left untouched until the entire structure is completed. In this way, the floor or floors are protected from the elements. It is not necessary to provide openings for the windows and other doors until all of the windows and doors have arrived on site.

Figure 6:
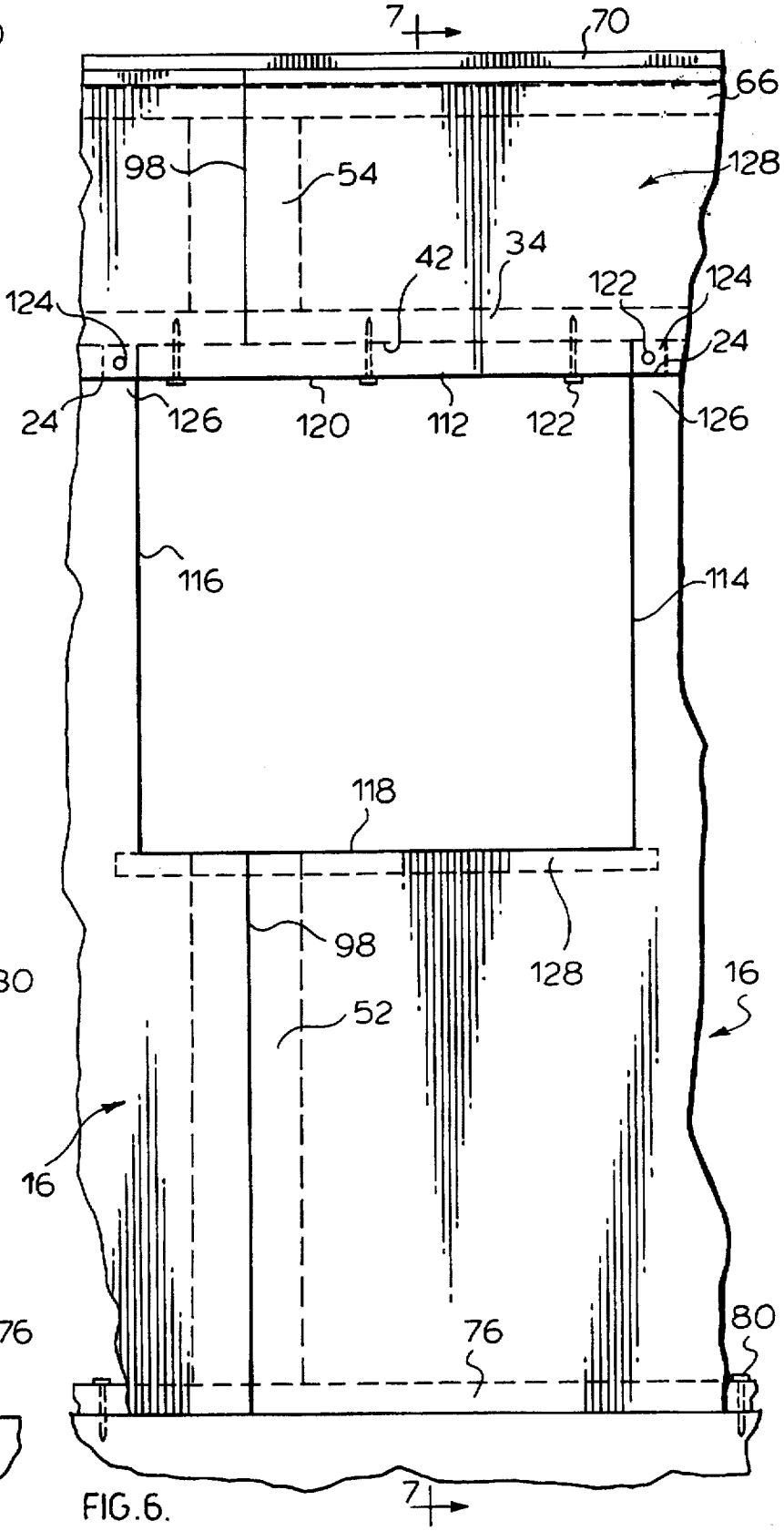
FIG. 6, is a side elevation showing a cut out for a window.

The openings for the doors and windows may be cut at any desired location in the perimeter wall without concern for the opening not being coincident within the perimeter of any one panel. FIG. 6 demonstrates where the opening for a window is made through interconnected panels to demonstrate an advantage of this invention. Line 24 as shown in FIG. 6 is permanently marked on the interior and exterior skins 28 and 30. Line 24 is spaced below the top header plate 34, a distance equivalent to the thickness of the bottom header plate to be placed below the top header after the opening is made. In accordance with normal construction, nominal 2×4 or 2×6 may be used for the top header. Correspondingly, the bottom header plate 112 is of the same nominal dimension whether the wall be of standard 2×4 or 2×6 thickness. The carpenter locates the desired position for the window. The top line of the window is already marked by line 25. The side lines for the window opening are marked at 114 and 116 and the bottom line 118 is marked for the bottom of the window opening. The carpenter then takes a suitable saw and cuts along line 24 between lines 114 and 116 and then completes cutting out the opening along lines 114, 116 and 118. Preferably, a sufficiently large saw is used to cut through the entire panel at once. When the cutting is complete, the block of material falls out where a cut has been made all the way through the connector stud 52. A thickness of foam is left between the upper edge of the opening 120 and the underside 42 of the top header plate. That foam may be chipped out to expose the underside 42. The carpenter chips out the foam beyond sides 114 and 116 along the underside 42 to approximately 1½" to 2" beyond each edge 114 and 116. The bottom header plate 112 is then inserted and is secured against the underside of the top plate 34 by use of suitable fasteners 122. The suitable fasteners 122 are also used to secure the inner and outer skins to the respective portion 124 of the bottom plate which projects beyond the edge 114 and 116 of the window opening. A suitable foaming agent is then used to fill in area 126 which has been chipped away to allow the inserting of the bottom header plate 112. The opening is now complete and ready to receive the window. No other reinforcing is required. It is therefore readily apparent that window openings and door openings can be located wherever desired. Based on load calculations, the opening can be of any desired width up to 6' without jeopardizing the load carrying capacity of the structural unit. Special panels are no longer required in the construction of the doors and windows. Indeed the openings can be rapidly created and window inserted, to ensure that the interior is closed to the elements. The window edge does not require any special treatment. As usual, the opening is slightly larger than the size of the window to facilitate leveling of the window. The foam core is even with the edge as shown at 114 in FIG. 7. The window is secured in place by using suitable fasteners to attach a nailer fin or strip of a window to the outer skin 30. The space between the window casing and the window opening can be filled with the same insulating foam that is used to fill crevice areas 126 beneath the bottom header 112. By virtue of the foam core, vapour barrier around the window is not required. Instead, the space between the window casing and the cut out opening is simply filled with foam.

By provision of the top header plate in each panel, a very effective building construction is provided. The panels which do not have openings cut out have extra reinforcing by virtue of the top header plate being secured between the inner and outer skins, with the opening cut in the panels. The region generally designated 128 above the top header panel 34 functions as a support beam above the window, where the load carried by the plate 70 is transferred through the outer skins and the top and bottom plates 34 and 112 to the floor 14 by way of the inner and outer skins on both sides of the window opening. This provides a very strong construction, yet facilitates positioning of openings wherever desired.

Figure 7:
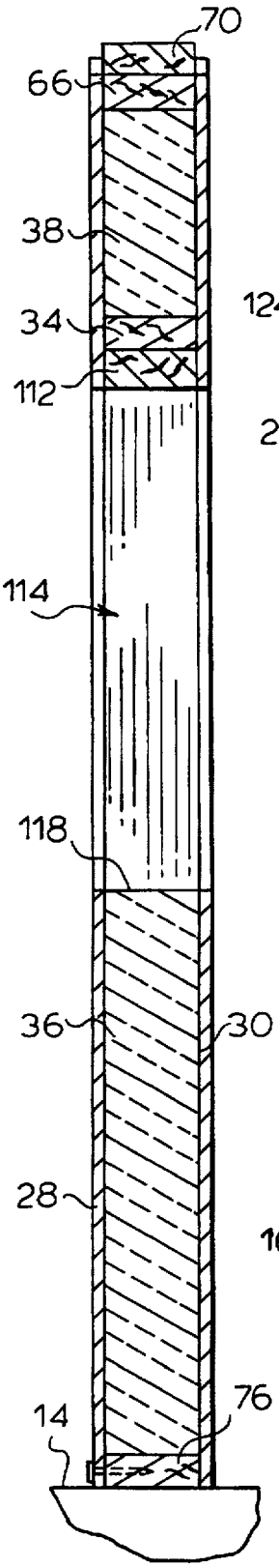
FIG. 7, is a section along line 7—7 of FIG. 6.
Figure 9:
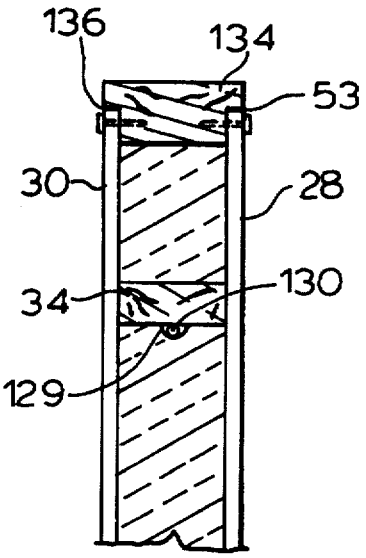
FIG. 9, is a panel section showing a post-tensioning cable.

It is also appreciated that where an opening of more than 6' is required, a post or mullion may be provided in the center of the opening. The foam along the bottom edge 118 of the opening may be chipped out and a window sill plate inserted between the inner and outer skins in the same manner as the bottom header plate 112 is inserted. Only the window sill plate between the inner and outer skins is secured to the skins by suitable fasteners. The window sill plate again would extend beyond the sides 114 and 116 of the opening by a distance of 1" to 2". The location of the optional sill plate for openings greater than 6' is shown in dotted line at 128 in FIG. 6. With reference to FIG. 9, an integrated top plate is provided as a substitute for the two individual top plates 66 and 70 as shown in FIGS. 6 and 7. The integral top plate may be manufactured or moulded from engineered lumber or laminate from two or more pieces of structural lumber to create a structural member which is "T" shaped in cross sectioned. The lower portion of the "T" shaped plate is of a width equal to that of the channel defined between the inner and outer skins 28 and 30. The top part of the top plate is equivalent to the exterior dimension of the skins 28 and 30. The "T" section for the top plate 134 provides shoulders 136 which rest on the upper edges 60 of the respective inner and outer skins 28 and 30. This "T" shaped top plate functions as an engineered T brace where the loads applied to the top plate are transferred directly to the inner and outer skins 28 and 30. This arrangement provides superior load carrying capacity compared to the top plates 66 and 70 because the load on the T shaped plate is transferred through the shoulders 136 directly under the upper edges of the skins.

Figure 10:
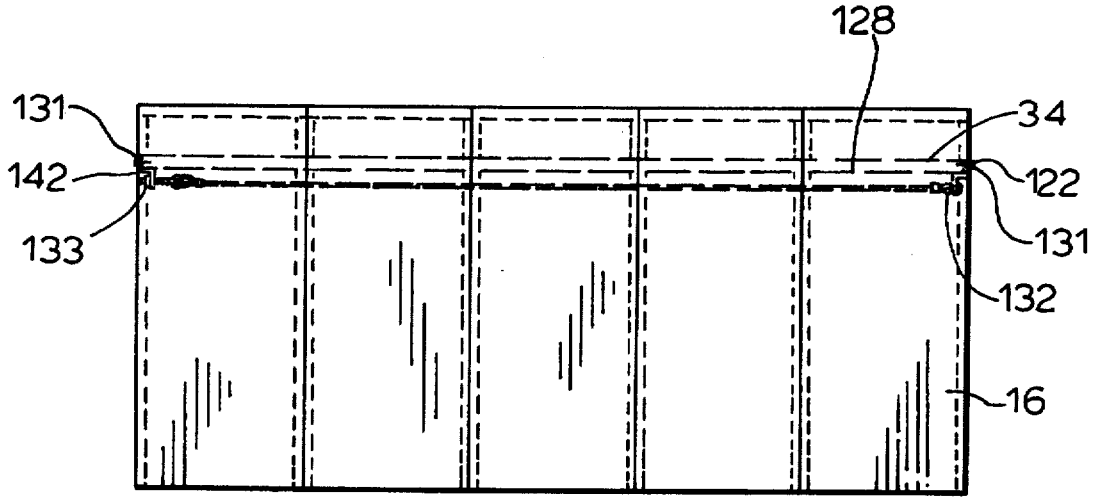
FIG. 10, shows assembled panels including a post-tensioning cable.

FIGS. 2A and 10 describe the use of cable to post-tension the panels where assembled into perimeter wall. The cable may pass through the panels directly underneath each top header plate. As shown in FIGS. 2 and 9, the cable may pass directly beneath the top header plate 34 where the insulation is grooved at 129 to allow passage of the cable 130. As the individual panels are assembled, the cable 130 is threaded through the passage way 129 such that at the completion of a perimeter wall assembly, the cable projects from each end of the erected wall. At one end of the erected wall, the cable is secured to the outermost edge 140 of the top header plate by use of a suitable bracket 131. The cable may be crimped or in some manner secured to the bracket 131 which is secured to the outermost edge 140 of the top header plate by fasteners 122. The cable may be secured directly to the plate 131, or may be connected by way of forming a cable loop 132 with appropriate cable crimping brackets to secure the cable to the bracket 131. Similarly, at the other end of the erected perimeter wall shown in FIG. 10, a bracket 131 is secured to the outermost end 142 of the top header plate. A suitable threaded eye bolt connection is provided which is threaded tight to draw the panels together by the tension force developed in the cable. The cable is crimped to the eye of the eye bolt to maintain thereby the post-tension on the perimeter wall. Such post-tensioning ensures that the walls are set in a straight line and by drawing the panels together, provides extra strength for the interconnection of the header plates. With such post-tensioning the walls are designed to survive forces associated with one hundred year storms, hurricanes, tornados and earthquakes. Optionally, if required, a similar installation for a post-tensioning cable may be located in a chase form below the window line and parallel to the base of the panels.

Significant benefits and advantages flow from this new design for the structural foam core panel. The perimeter wall can be easily and quickly erected where the interior of the building is weather tight and protected from inclement weather such as snow, wind and rain when the roof or second floor is applied. Interior work can be resumed such as interior partitioning, plumbing and electrical. It is understood in accordance with standard structural foam core panelling, that passage ways may be formed in the panel during manufacture of the panel to provide for electrical runways and the like, holes in connector stud 52, may be provided to align with the holes that are formed in the foam, provide continuous passage ways for wiring and plumbing. When the perimeter is complete, there is no further need for insulation. The gypsum board finish or the like may be applied directly to the inner skin by screws or adhesives. Unlike standard stick construction where studs tend to shrink and bow, this does not happen with the foam core panel construction. By virtue of the straight and through bottom plate and top plates, the perimeter wall when completed, is plumb and true. The exterior of the perimeter wall may be finished in a variety of ways such as prefinished exterior sheeting. In one embodiment of the invention, the exterior sheeting may constitute the outer skin 30. The window openings when cut in the walls can be dimensionally correct based on the windows when they arrive at the site. The built-in top plate header system, provides excellent insulation and strength above the window. The structural units facilitate rapid erection of buildings, particularly cottages by the do-it-yourself. The overall cost of the building is reduced, where the labour force required to erect the walls does not have to be skilled. Depending upon the building design, the structural loads to be carried by the panels can be pre-engineered, where the thickness of the walls is normally selected to be 2×4 thickness or 2×6 thickness. It is also appreciated that these panels may be used in basement construction, where the inner and outer skins are formed of below grade materials, where again the openings for the basement windows and sliding doors and the like can be cut wherever desired. By virtue of not requiring wind bracing, the entire floor is left open for assembly of interior partitions even after the other floors are applied or the roof, except of course, the erection of load bearing partitions.

Although preferred embodiments of the invention are described herein in detail, it will be understood by those skilled in the art that variations may be made thereto without departing from the spirit of the invention or the scope of the appended claims.

We claim:

1. A structural foam core panel for use in building construction having inner and outer structural skins with interconnecting insulating foam core to form a structural building unit of standard building height and width such that when several panels are erected and interconnected in series, a load bearing wall is formed; said panel having a top load carrying header plate in contact with and bridging and secured to said inner and outer structural skins with said foam core provided above and below said header plate, said top header plate spanning the width of said panel and extending parallel to a bottom edge of said panel, said header plate having an underside spaced from said panel bottom edge a predetermined height to provide thereby load carrying support above a window opening or a door opening subsequently cut in said panel after interconnection of several panels in erecting a perimeter load bearing building wall.

2. A structural foam core panel of claim 1, wherein said inner and outer skins are adhered to opposite sides of said foam core above and below said top header plate.

3. A structural foam core panel of claim 2 wherein opposite sides of said header plate are adhered to said inner and outer skins.

4. A structural foam core panel of claim 1 wherein said foam core is inset for top, bottom and side edges of said inner and outer skins to define a channel about the perimeter of the panel, said channel along said bottom and top of said panel is adapted to receive a bottom and a top building, said channel on each side is adapted to receive a connector stud below said top header plate and a connector cripple stud above said top header plate.

5. A structural foam core panel of claim 1 wherein said inner and outer skins are of building grade sheeting of a thickness in the range of 7/16" to ¾" thickness.

6. A structural foam core panel of claim 5 wherein said standard building width and height is 4' by 8'.

7. A structural foam core panel of claim 6 wherein said top header plate is of standard dimensional lumber of 2" thickness and a width of 4" or 6".

8. A structural foam core panel of claim 1 wherein a permanent line is provided across the width of said inner and outer skins, said line defining a top edge of an opening to be cut out for a door or window.

9. A structural foam core panel of claim 8 wherein said foam is sufficiently pliable to permit removal of foam between an opening top edge cut along said line and said underside of said top header plate and removable to either side of such opening beneath said top header plate to permit installation of a bottom header plate to be secured to said top header plate.

10. A building perimeter wall erected from a plurality of interconnected panels of claim 1, a cable extending through the interconnected panels adjacent said top header plate of each plate and means to post-tension said cable to reinforce said interconnection of said plurality of panels.

* * * * *